US010224671B2

(12) United States Patent
Sekino et al.

(10) Patent No.: US 10,224,671 B2
(45) Date of Patent: Mar. 5, 2019

(54) ELECTRICAL CONNECTOR HAVING A SHORT-CIRCUITING TERMINAL

(71) Applicant: YAZAKI CORPORATION, Tokyo (JP)

(72) Inventors: Tetsuya Sekino, Shizuoka (JP); Nobuyuki Sakamoto, Shizuoka (JP); Toshinori Yamamoto, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/659,736

(22) Filed: Jul. 26, 2017

(65) Prior Publication Data

US 2018/0034203 A1 Feb. 1, 2018

(30) Foreign Application Priority Data

Jul. 29, 2016 (JP) ..... 2016-149197

(51) Int. Cl.
*H01R 29/00* (2006.01)
*H01R 13/627* (2006.01)
(Continued)

(52) U.S. Cl.
CPC ..... *H01R 13/6272* (2013.01); *H01R 13/2464* (2013.01); *H01R 13/28* (2013.01);
(Continued)

(58) Field of Classification Search
CPC . H01R 13/641; H01R 13/703; H01R 13/7031
(Continued)

(56) References Cited

U.S. PATENT DOCUMENTS 5,466,168 A 11/1995 Liebich et al.
5,527,186 A 6/1996 Ito et al.
(Continued)

FOREIGN PATENT DOCUMENTS

CN 1209667 A 3/1999
CN 102160241 A 8/2011
(Continued)

OTHER PUBLICATIONS

Communication dated Oct. 23, 2018 issued by the State Intellectual Property Office of People's Republic of China in counterpart application No. 201710639402.X.
(Continued)

*Primary Examiner* — Hae Moon Hyeon
(74) *Attorney, Agent, or Firm* — Sughrue Mion, PLLC

(57) ABSTRACT

A connector includes a first housing housing a plurality of first terminals, a second housing being fittable to the first housing and housing a plurality of second terminals connectable to the respective first terminals, a short-circuiting terminal housed in the first housing and having contact pieces contacting the respective first terminals which are adjacent to each other, and a release portion provided on the second housing and displacing the contact pieces to release contact between the first terminals and the contact pieces. The second housing is deflectably provided with a lock arm on an outer peripheral surface of the second housing, the lock arm holding a state in which the first housing and the second housing are fit together. The release portion is arranged on the outer peripheral surface of the second housing forward of the lock arm in a fitting direction of the first housing and the second housing.

6 Claims, 10 Drawing Sheets

(51) Int. Cl.

| | |
|---|---|
| ***H01R 13/28*** | (2006.01) |
| ***H01R 13/24*** | (2006.01) |
| ***H01R 31/08*** | (2006.01) |
| ***H01R 13/639*** | (2006.01) |
| ***H01R 13/703*** | (2006.01) |
| *H01R 103/00* | (2006.01) |

(52) U.S. Cl.
CPC ..... *H01R 13/639* (2013.01); *H01R 13/7032* (2013.01); *H01R 31/08* (2013.01); *H01R 2103/00* (2013.01)

(58) Field of Classification Search
USPC ..... 439/188, 88
See application file for complete search history.

(56) References Cited

U.S. PATENT DOCUMENTS

| | | | | |
|---|---|---|---|---|
| 5,598,624 | A | 2/1997 | Ito et al. | |
| 6,036,515 | A | 3/2000 | Nakamura | |
| 6,135,802 | A * | 10/2000 | Nakamura | H01R 13/453 439/138 |
| 6,186,805 | B1 * | 2/2001 | Krishnaswamy | H01R 13/7032 200/51.1 |
| 6,361,334 | B1 * | 3/2002 | Konoya | H01R 13/447 439/144 |
| 6,575,775 | B2 * | 6/2003 | Hasegawa | H01R 13/41 439/188 |
| 6,592,398 | B2 * | 7/2003 | Kashiyama | H01R 13/641 439/188 |
| 6,942,510 | B2 * | 9/2005 | Nakamura | H01R 13/7032 439/188 |
| 6,997,726 | B2 * | 2/2006 | Buden | H01R 13/701 200/51.1 |
| 7,618,274 | B2 * | 11/2009 | Nakamura | H01R 13/641 439/188 |
| 7,955,104 | B1 | 6/2011 | Wicks et al. | |
| 8,366,493 | B2 * | 2/2013 | Nakamura | H01R 13/4223 439/752 |
| 8,485,836 | B2 * | 7/2013 | Nakamura | H01R 13/4223 439/188 |
| 9,142,919 | B2 * | 9/2015 | Osada | H01R 13/6272 |
| 2001/0036768 | A1 | 11/2001 | Hasegawa et al. | |
| 2003/0060078 | A1 | 3/2003 | Kashiyama et al. | |
| 2003/0077936 | A1 * | 4/2003 | Tsuji | H01R 13/6271 439/489 |
| 2004/0067676 | A1 * | 4/2004 | Nimura | H01R 13/6272 439/352 |
| 2005/0074997 | A1 * | 4/2005 | Nakamura | H01R 13/7032 439/188 |
| 2009/0035980 | A1 * | 2/2009 | Nakamura | H01R 13/641 439/352 |
| 2010/0055972 | A1 * | 3/2010 | Nakamura | H01R 13/5812 439/489 |
| 2011/0217864 | A1 | 9/2011 | Sasaki et al. | |
| 2012/0225574 | A1 | 9/2012 | Nakamura | |
| 2013/0040488 | A1 | 2/2013 | Nakamura | |
| 2013/0210266 | A1 * | 8/2013 | Osada | H01R 13/6272 439/378 |
| 2015/0079827 | A1 | 3/2015 | Hara | |
| 2016/0104965 | A1 | 4/2016 | Tanikawa | |
| 2016/0190750 | A1 | 6/2016 | Shinmi | |
| 2018/0034180 | A1 * | 2/2018 | Sekino | H01R 13/28 |
| 2018/0034184 | A1 * | 2/2018 | Sekino | H01R 13/428 |
| 2018/0034187 | A1 * | 2/2018 | Sekino | H01R 13/4368 |
| 2018/0034217 | A1 * | 2/2018 | Sekino | H01R 13/7031 |

FOREIGN PATENT DOCUMENTS

| | | | |
|---|---|---|---|
| CN | 102403610 | A | 4/2012 |
| CN | 104466523 | A | 3/2015 |
| CN | 105191009 | A | 12/2015 |
| JP | 06-151009 | A | 5/1994 |
| JP | 6-511108 | A | 12/1994 |
| JP | 10-289755 | A | 10/1998 |
| JP | 2001297827 | A | 10/2001 |
| JP | 2002305057 | A | 10/2002 |
| JP | 2003-36943 | A | 2/2003 |
| JP | 2010-257917 | A | 11/2010 |
| JP | 2015-56369 | A | 3/2015 |

OTHER PUBLICATIONS

Communication dated Jul. 24, 2018, from the Japanese Patent Office in counterpart application No. 2016-149197.
Communication dated Jan. 22, 2019 from the Japanese Patent Office in counterpart application No. 2016-149197.

* cited by examiner

ELECTRICAL CONNECTOR HAVING A SHORT-CIRCUITING TERMINAL

CROSS REFERENCE TO RELATED APPLICATIONS

This application claims the priority of Japanese Patent Application No. 2016-149197, filed on Jul. 29, 2016, the entire content of which are incorporated herein by reference.

BACKGROUND

Technical Field

The present invention relates to a connector. More specifically, the present invention relates to a connector having a short-circuiting terminal for connecting a plurality of terminals housed in a housing.

Related Art

Conventional connectors include a first housing housing male terminals as a plurality of first terminals, a second housing housing female terminals as a plurality of second terminals connectable to the respective male terminals, wherein the second housing is fittable to the first housing, a short-circuiting terminal housed in the first housing, wherein the short-circuiting terminal has contact pieces contacting the respective male terminals which are adjacent to each other, and a release portion provided on the second housing, wherein the release portion displaces the contact pieces to release contact between the female terminals and the contact pieces (See, for example, JP 06-151009 A).

In this connector, for example, two adjacent male terminals among the plurality of male terminals housed in the first housing are connected to an airbag circuit that controls the operation of the airbag.

The two adjacent male terminals are connected with each other through the short-circuiting terminal by contacting the contact pieces of the short-circuiting terminal housed in the first housing in a state where the first housing and the second housing are not fit with each other.

In this manner, since the two male terminals are connected with each other via the short-circuiting terminal in a state where the first housing and the second housing are not fit with each other, no potential difference is generated between the two male terminals, thereby preventing malfunction of the airbag.

In the connection between the two female terminals and the short-circuiting terminal, when the first housing and the second housing are fit, the release portion of the second housing is inserted between the male terminals and the contact piece of the short-circuiting terminal. The contact piece is displaced and the contact between the male terminal and the contact piece is released. The connection between the two male terminals and the short-circuiting terminal is released.

SUMMARY

In the connector as disclosed in JP 06-151009 A, a lock arm that holds a fitting state with the first housing is deflectably provided on the outer peripheral surface of the second housing. The release portion is arranged on both sides of the lock arm on the outer peripheral surface of the second housing.

For this reason, in the connector such as the one described in the JP 06-151009 A, the second housing is enlarged in the width direction, and the short-circuiting terminal having the contact piece from which the contact with the adjacent first terminals are released by the release portion has also been increased in the width direction.

It is therefore an object of the present invention to provide a connector that can be downsized.

A connector according to an aspect of the present invention includes a first housing housing a plurality of first terminals, a second housing housing a plurality of second terminals connectable to the respective first terminals, the second housing being fittable to the first housing, a short-circuiting terminal housed in the first housing, the short-circuiting terminal having contact pieces contacting the respective first terminals which are adjacent to each other, and a release portion provided on the second housing, the release portion displacing the contact pieces to release contact between the first terminals and the contact pieces. The second housing is deflectably provided with a lock arm on an outer peripheral surface of the second housing, the lock arm holding a state in which the first housing and the second housing are fit together. The release portion is arranged on the outer peripheral surface of the second housing forward of the lock arm in a direction in which the first housing and the second housing are fit together.

Since the release portion is arranged on the outer peripheral surface of the second housing forward of the lock arm in a direction in which the first housing and the second housing are fit together, the release portion is not arranged on both sides of the lock arm and the second housing can be downsized in the width direction.

Further, the short-circuiting terminal having the contact pieces from which the contact with the adjacent first terminals is released by the release portion need not to be formed such that the contact piece contacting the adjacent first terminals avoids interference with the lock arm. Thus, the short-circuiting terminal can be downsized in the width direction.

Therefore, in the connector, the second housing and the short-circuiting terminal can be downsized in the width direction.

The first housing may be provided with a short-circuiting terminal housing chamber which houses the short-circuiting terminal. The short-circuiting terminal housing chamber may be arranged to face the lock arm in the direction in which the first housing and the second housing are fit together.

Since the short-circuiting terminal housing chamber is arranged to face the lock arm in the direction in which the first housing and the second housing are fit, the height of the first housing can be reduced. Thus, the connector can be downsized.

A connector according to the aspect of the present invention provides a connector that can be downsized.

DETAILED DESCRIPTION

Figure 1:
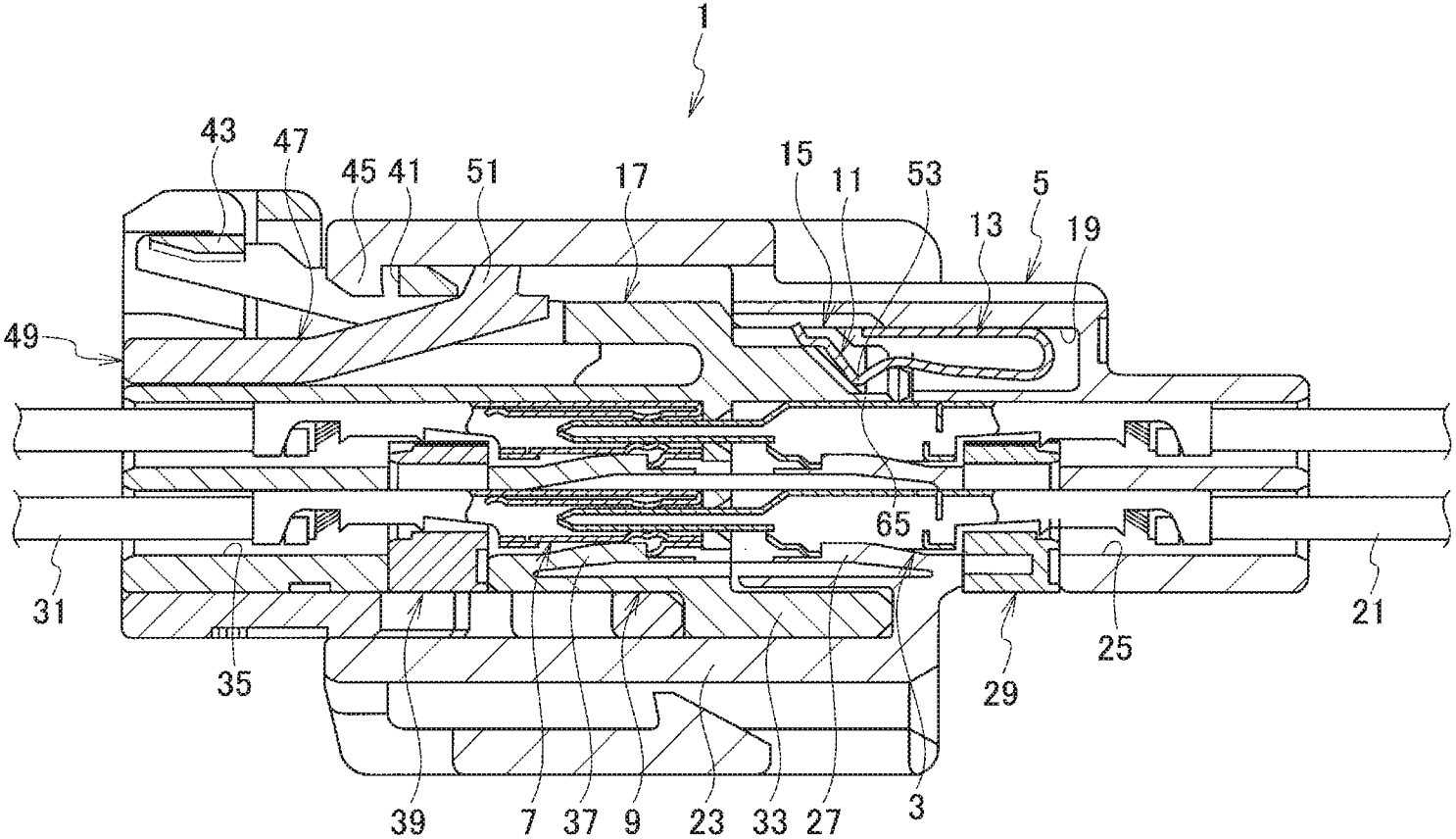
FIG. 1 is a cross-sectional view of a connector according to an embodiment of the present invention.
Figure 2:
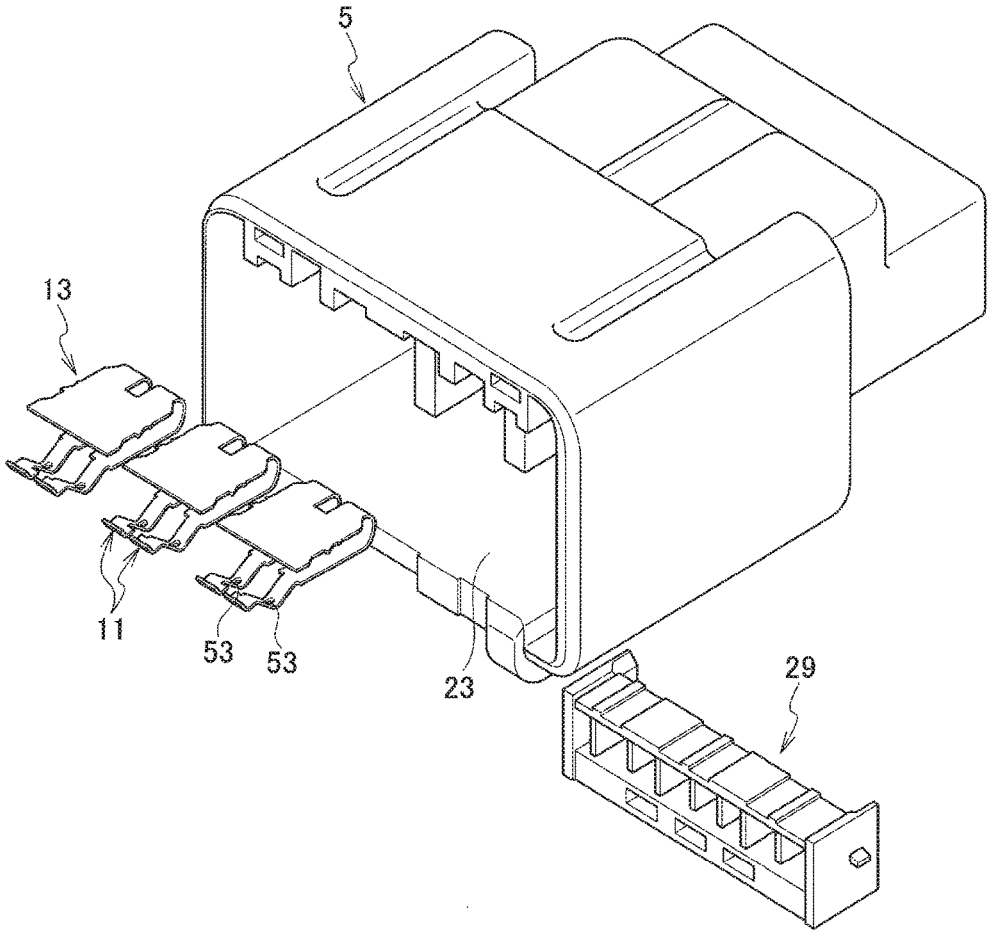
FIG. 2 is an exploded perspective view of a first housing of a connector according to the embodiment of the present invention.
Figure 3:
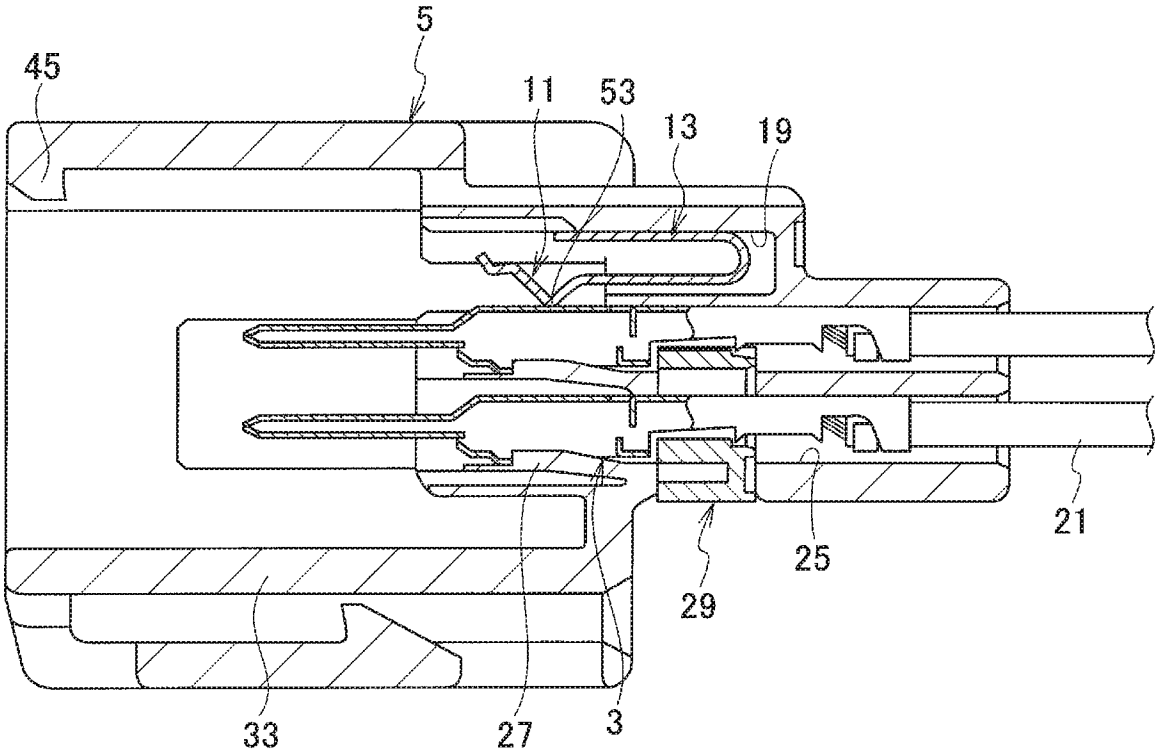
FIG. 3 is a cross-sectional view of a first housing of a connector according to the embodiment of the present invention.
Figure 4:
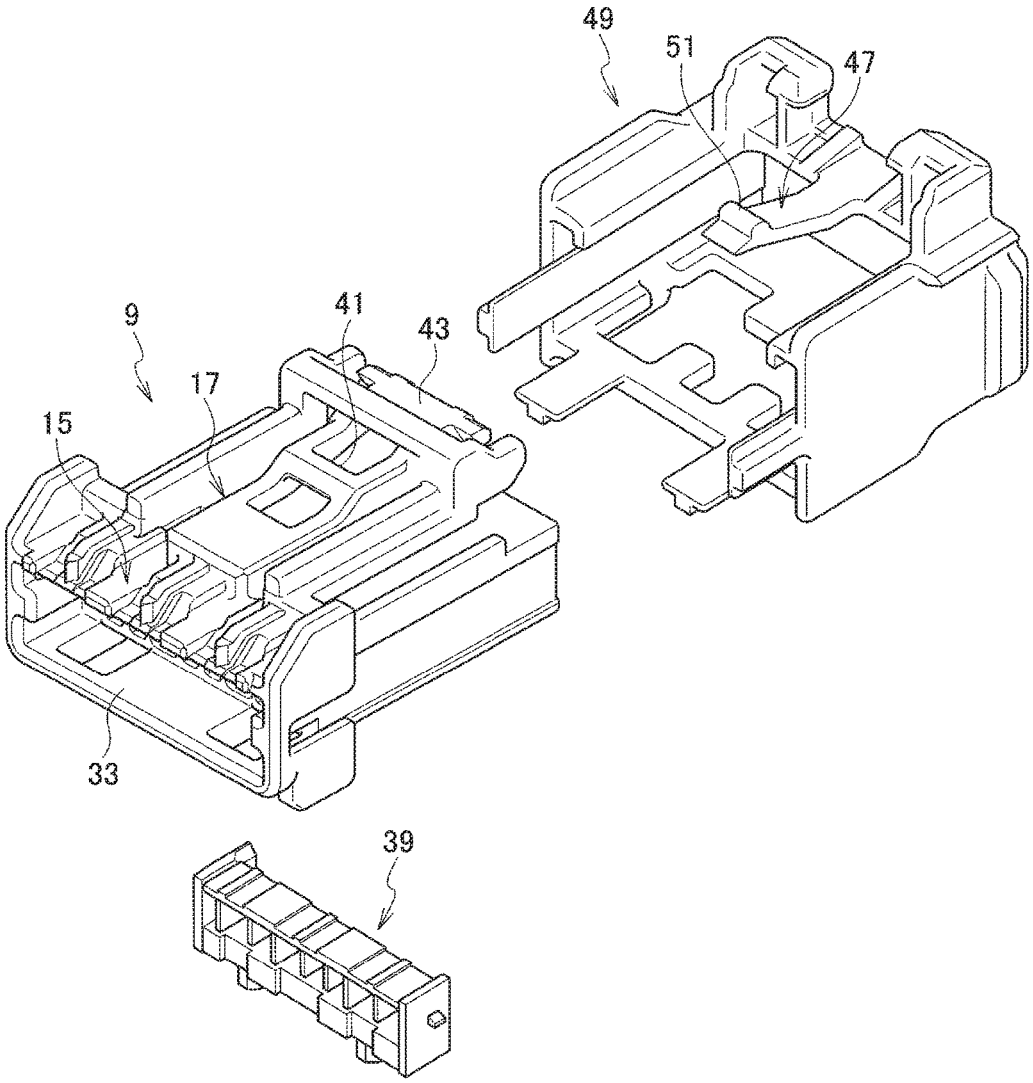
FIG. 4 is an exploded perspective view of a second housing of a connector according to the embodiment of the present invention.
Figure 5:
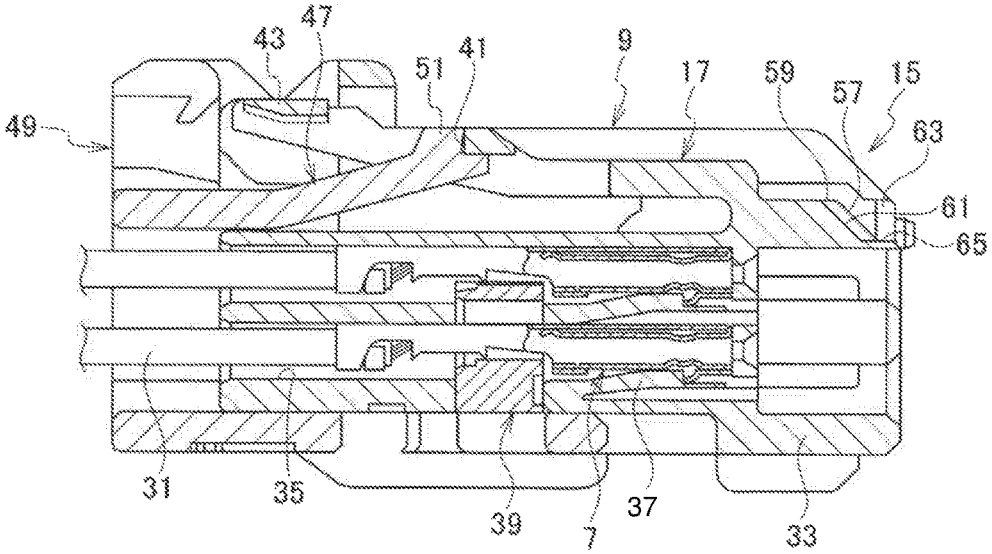
FIG. 5 is a cross-sectional view of a second housing of a connector according to the embodiment of the present invention.
Figure 6:
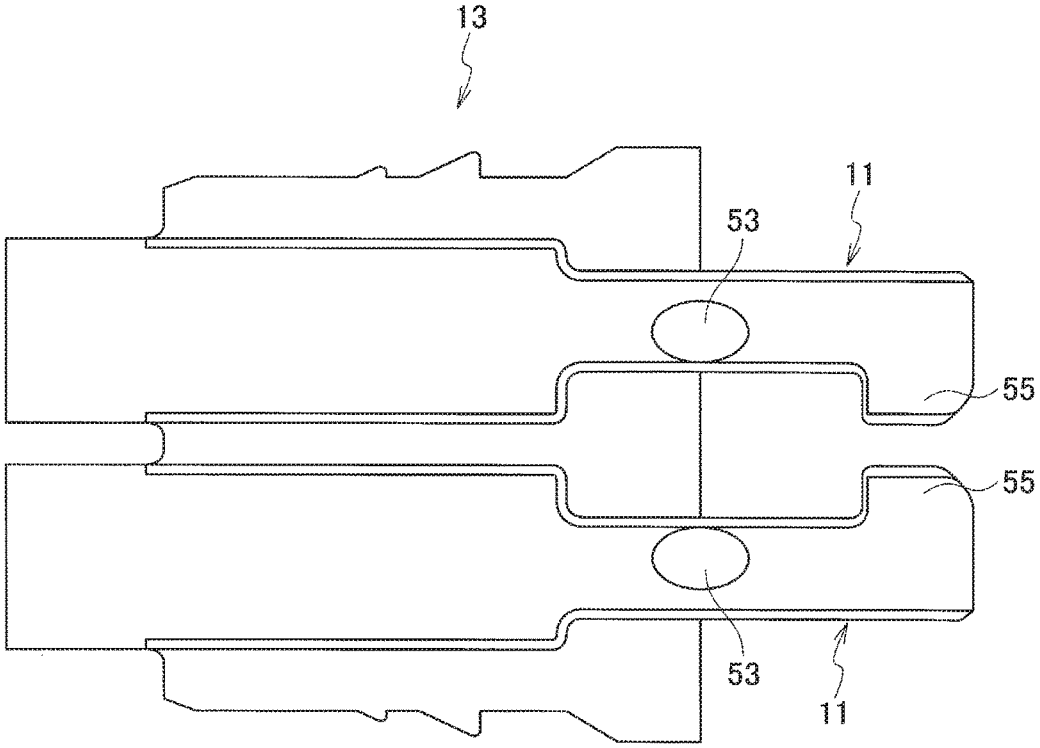
FIG. 6 is a plan view of a short-circuiting terminal of a connector according to the embodiment of the present invention.
Figure 7:
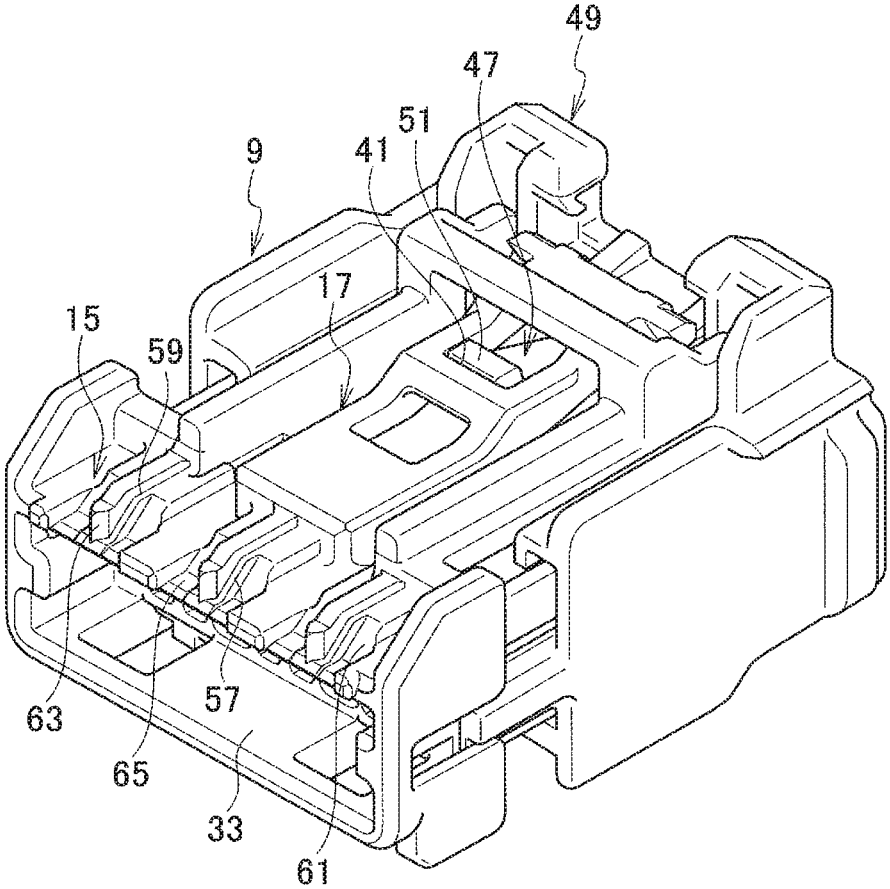
FIG. 7 is a perspective view of the second housing of the connector according to the embodiment of the present invention.
Figure 8:
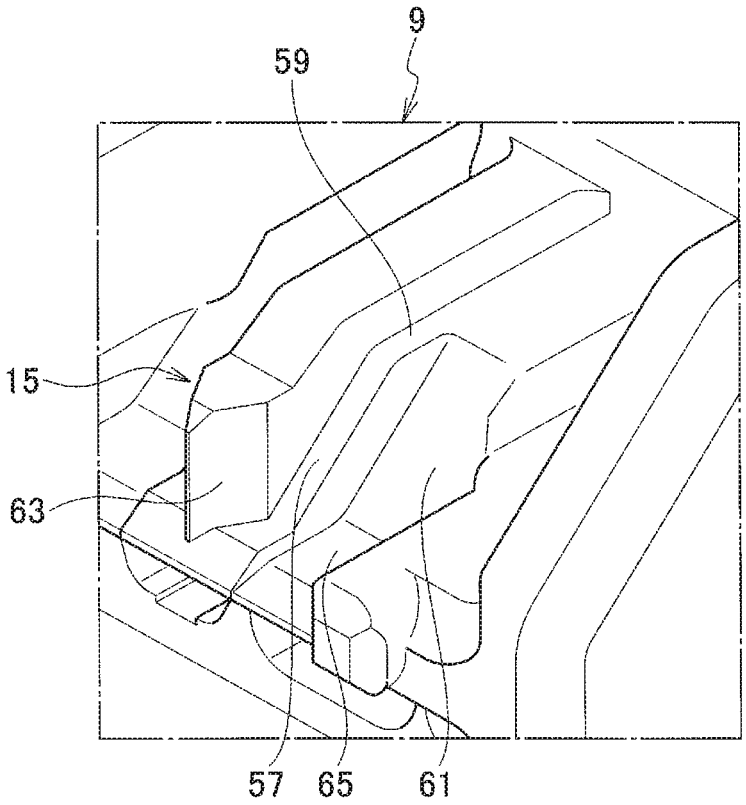
FIG. 8 is an enlarged view of a main part of FIG. 7.
Figure 9:
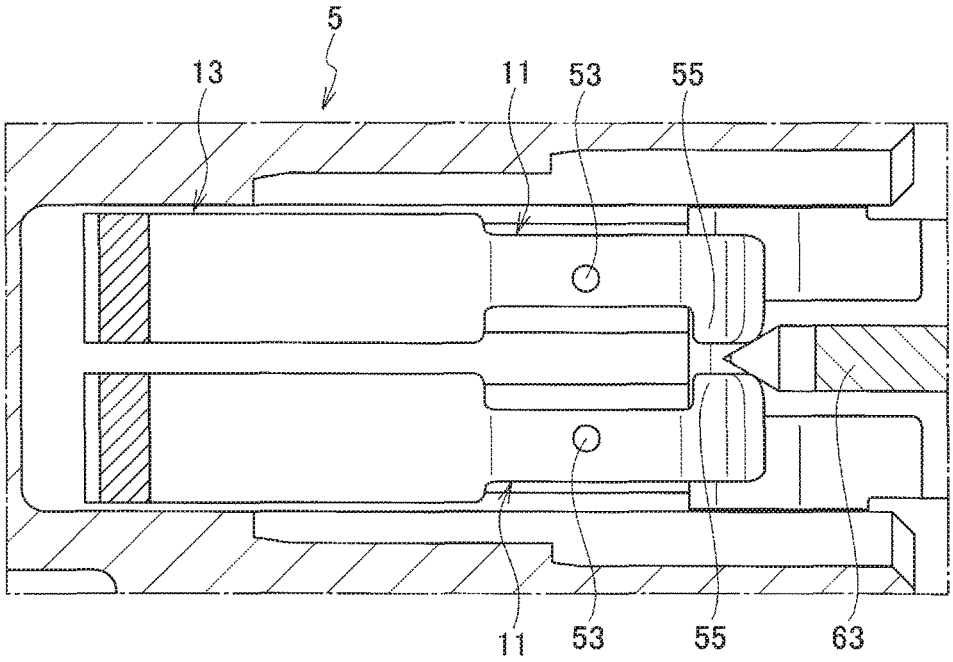
FIG. 9 is an enlarged cross-sectional view of the essential part when fitting the first housing and the second housing of the connector according to the embodiment of the present invention.
Figure 10:
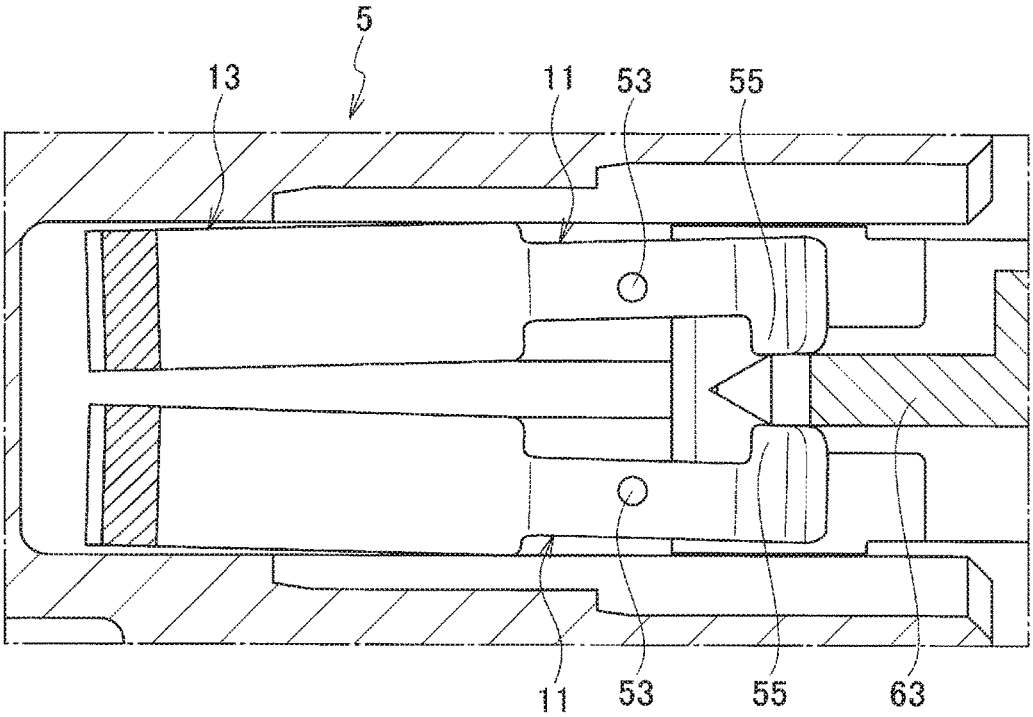
FIG. 10 is an enlarged cross-sectional view of an essential part when the first housing and the second housing of the connector according to the embodiment of the present invention are fit together.

A connector according to an embodiment of the present invention will be described with reference to FIGS. 1 to 10.

The connector 1 according to the present embodiment includes a first housing 5 housing a plurality of first terminals 3, a second housing 9 housing a plurality of second terminals 7 connectable to the respective first terminals 3, the second housing 9 being fittable to the first housing 5, a short-circuiting terminal 13 housed in the first housing 5, the short-circuiting terminal 13 having contact pieces 11, 11 contacting the respective first terminals 3, 3 which are adjacent to each other, and a release portion 15 provided on the second housing 9, the release portion 15 displacing the contact pieces 11 to release contact between the first terminals 3 and the contact pieces 11.

The second housing 9 is deflectably provided with a lock arm 17 on an outer peripheral surface of the second housing 9, the lock arm 17 holding a state in which the first housing 5 and the second housing 9 are fit together.

The release portion 15 is arranged on the outer peripheral surface of the second housing 9 forward of the lock arm 17 in a direction in which the first housing 5 and the second housing 9 are fit together.

The first housing 5 is provided with a short-circuiting terminal housing chamber 19 which houses the short-circuiting terminal 13.

The short-circuiting terminal housing chamber 19 is arranged to face the lock arm 17 in the direction in which the first housing 5 and the second housing 9 are fit together.

As shown in FIGS. 1 to 10, each of a plurality of first terminals 3 is composed of a male terminal having a tab-shaped connecting portion. The plurality of first terminals 3 are electrically connected to respective terminal portions of a plurality of electric wires 21 connected to an airbag circuit for controlling the operation of the airbag.

The plurality of first terminals 3 are inserted into the first housing 5 through an opening formed in the first housing 5 and housed in the first housing 5.

The first housing 5 is made of an insulating material such as synthetic resin. The first housing 5 is provided with a first fitting portion 23 into which the second housing 9 can be fit on the opposite side of the opening into which the first terminal 3 is inserted. A plurality of first terminal housing chambers 25 for housing the first terminals 3 are provided on the bottom of the first fitting portion 23.

A first locking lance 27 for locking the first terminal 3 is deflectably provided in each of the plurality of first terminal housing chambers 25 of the first housing 5. Furthermore, the first housing 5 is provided with a hole portion communicating with the plurality of first terminal housing chambers 25. By inserting the first spacer 29 into the hole portion, the plurality of first terminals 3 inserted into the first housing 5 are double-locked in the first housing 5 by the first locking lances 27 and the first spacer 29.

The plurality of first terminals 3 housed in the first housing 5 as described above are connected to the plurality of second terminals 7 housed in the second housing 9 by fitting the second housing 9 into the first fitting portion 23 of the first housing 5.

Each of the plurality of second terminals 7 is constituted by a female terminal having a box-like connecting portion into which the tab-like connecting portion of the first terminal 3 can be inserted. The plurality of second terminals 7 are electrically connected to respective terminal portions of a plurality of electric wires 31 connected to a power source, a device, or the like.

The plurality of second terminals 7 are inserted into the second housing 9 through openings formed in the second housing 9 and housed in the second housing 9.

The second housing 9 is made of an insulating material such as a synthetic resin. The second housing 9 is provided with the second fitting portion 33 that can be inserted into the first fitting portion 23 of the first housing 5 on the opposite side of the opening into which the second terminal 7 is inserted. A plurality of second terminal housing chambers 35 for housing the second terminals 7 are provided inside the second fitting portion 33.

A second locking lance 37 for locking the second terminal 7 is deflectably provided in each of the plurality of second terminal housing chambers 35 of the second housing 9. The second housing 9 is provided with a hole portion communicating with the plurality of second terminal housing chambers 35. By inserting the second spacer 39 into this hole portion, the plurality of second terminals 7 inserted into the second housing 9 are double-locked in the second housing 9 by the second locking lance 37 and the second spacer 39.

By the fitting of the second fitting portion 33 of the second housing 9 and the first fitting portion 23 of the first housing 5, the first terminal 3 housed in the first housing 5 is electrically connected to the second terminal 7 housed in the second housing 9.

The fit state of the first housing 5 and the second housing 9 is held by a lock arm 17 which is deflectably provided on the outer peripheral surface of the second housing 9.

The lock arm 17 is formed in a frame shape, and is deflectably provided on the upper surface of the second housing 9. The lock arm 17 includes an engagement hole portion 41 provided at its center portion and an operation portion 43 provided at its free end.

When the first housing 5 and the second housing 9 are fit to each other, an engagement protrusion 45 provided at the opening end of the first fitting portion 23 of the first housing 5 is fit to the engagement hole portion 41 of the lock arm 17.

The fitting state between the first housing 5 and the second housing 9 is held by the engagement between the engagement hole portion 41 and the engagement protrusion 45.

The engagement between the engagement hole portion 41 and the engagement protrusion 45 is released by pushing the operation portion 43 downward and deflecting the lock arm 17 downward. This makes it possible to release the fitting between the first housing 5 and the second housing 9.

A cap housing 49 is assembled to the second housing 9 on the outer periphery of the second housing 9 on the drawer side of the electric wire 31 via a locking arm 47 that is deflectable with respect to.

A locking protrusion 51 engaged with the engagement hole portion 41 of the lock arm 17 is provided at the free end of the locking arm 47 of the cap housing 49.

When the engagement hole portion 41 and the locking protrusion 51 are engaged with each other, the cap housing 49 is retained at the temporary locking position (see FIG. 5) with respect to the second housing 9.

When the first housing 5 and the second housing 9 are fit to each other, the engagement protrusion 45 of the first housing 5 come into contact with the locking protrusion 51, whereby the locking arm 47 are deflected downward. Thus, the engagement between the engagement hole portion 41 and the locking protrusion 51 is released.

By the release of the engagement between the engagement hole portion 41 and the locking protrusion 51, the cap housing 49 can shift to the full locking position (see FIG. 1) relative to the second housing 9.

When the first housing 5 and the second housing 9 are half-fit together, the cap housing 49 is provisionally locked at the temporary locking position. When the first housing 5 and the second housing 9 are fit together, the locking position of the locking protrusion 51 of the cap housing 49 is shifted to the full locking position.

In this way, the state in which the first housing 5 and the second housing 9 are fit together can be detected by the transition between the temporary locking position and the full locking position of the cap housing 49 with respect to the second housing 9.

In a state where the fitting between the first housing 5 and the second housing 9 is released for maintenance or the like, a potential difference occurs due to static electricity or the like between the plurality of first terminals 3 which are housed in the first housing 5 and which are connected to the airbag circuit. Thus, the airbag may malfunction.

Therefore, in order to prevent a potential difference from occurring between the plurality of the first terminals 3, a plurality of short-circuiting terminal 13 for electrically connecting two adjacent first terminals 3, 3 among the plurality of the first terminals 3 are housed in short-circuiting terminal housing chamber 19 provided in the first housing 5.

The short-circuiting terminal housing chamber 19 is arranged to face the lock arm 17 of the second housing 9 in the direction in which the first housing 5 and the second housing 9 are fit together.

By providing the short-circuiting terminal housing chamber 19 in the first housing 5 as described above, the height of the first housing 5 can be reduced, and the first housing 5 can be downsized.

The plurality of short-circuiting terminal 13 are each made of a single conductive material subjected to press working or bending, and have two contact pieces 11, 11, each elastically deformable at one end.

The two contact pieces 11, 11 are provided so as to be elastically deformable in either the up-down direction or the left-right direction. Each contact piece 11 has a contact portion 53 protruding toward the first terminal 3 in a state of being housed in the first housing 5 in the first housing 5 on a free end side.

The contact portion 53 is brought into contact with the outer peripheral surfaces of the two adjacent first terminals 3, 3 by a predetermined urging force of each contact piece 11. As a result, the two adjacent first terminals 3, 3 are electrically connected via the short-circuiting terminal 13.

As described above, by electrically connecting the two first terminals 3, 3 via the short-circuiting terminal 13, it is possible to prevent a potential difference from occurring between the two first terminals 3, 3. Thus, erroneous operation of the airbag can be prevented.

A sliding protrusion 55 is provided on each contact piece 11 provided with the contact portion 53.

The sliding protrusion 55 is provided as a part of the short-circuiting terminal 13 continuing to the contact piece 11. The sliding protrusion 55 protrudes in the width direction. The sliding protrusion 55 is provided on the further free end side of the contact portion 53 in the contact piece 11 so that the position in the length direction of the contact piece 11 is different from the contact portion 53.

When the first housing 5 and the second housing 9 are fit together, the sliding protrusion 55 slides on the sliding slope 57 of the release portion 15 of the second housing 9. As a result, each contact piece 11 is displaced, and the contact between the contact portion 53 and the first terminal 3 is released.

The release portion 15 is arranged on the outer peripheral surface of the second housing 9 forward of the lock arm 17 in the direction in which the first housing 5 and the second housing 9 are fit together. The release portion 15 includes a sliding slope 57, a support portion 59, a contact housing portion 61, and a displacement portion 63.

The sliding slope 57 is formed of one member which is continuous with the second housing 9 at the end of the second housing 9 on the first housing 5 side. At this time, the sliding slope 57 has an inclined surface inclined upward from the first housing 5 toward the second housing 9.

When the first housing 5 and the second housing 9 are fit together, the sliding slope 57, at its lower end, comes into contact with the sliding protrusion 55 of each contact piece 11 of the short-circuiting terminal 13. When the fitting between the first housing 5 and the second housing 9 progresses, the sliding protrusion 55 of each contact piece 11 slides along the sliding slope 57, and each contact piece 11 is displaced upward.

Due to the displacement of each contact piece 11 by the sliding slope 57, the contact between the contact portion 53 of each contact piece 11 and the first terminal 3 is released, and the electrical connection between the adjacent first terminals 3 and 3 is released.

The support portion 59 is formed of one member continuous with the second housing 9, and has a flat surface extending continuously from the upper end of the sliding slope 57 toward the second housing 9 in the fitting direction.

In a state where the first housing 5 and the second housing 9 are fit to each other, the support portion 59 comes into contact with the sliding protrusion 55 of each contact piece 11 of the short-circuiting terminal 13, thereby holding the state in which each contact piece 11 is displaced upward.

Since the support portion 59 holds the state of displacement of each contact piece 11, each contact piece 11 does not restore downward. Thus, it is possible to hold the contact release state between the contact portion 53 of each contact piece 11 and the first terminal 3.

The contact housing portion 61 is formed of one member continuous with the second housing 9. The contact housing portion 61 is a concave portion arranged in the side opposite to the protruding direction of the sliding protrusion 55 with respect to the sliding slope 57 and the support portion 59 in the width direction of the second connector housing 9.

From the start of fitting between the first housing 5 and the second housing 9 to the completion of fitting, the contact housing portion 61 houses the contact portion 53 while its inner wall surface is spaced away so as not to interfere with the contact portion 53 of each contact piece 11 of the short-circuiting terminal 13.

That is, while each contact piece 11 is displaced, the contact portion 53 of each contact piece 11 is housed in the contact housing portion 61, and the contact portion 53 does not interfere with the sliding slope 57, the support portion 59, or the inner wall surface of the contact housing portion 61.

Since the contact housing portion 61 houses the contact portion 53, the contact portion 53 is not involved in the displacement of each contact piece 11. Thus, it is possible to prevent the contact portion 53 from being damaged or deformed. Thereby, the contact portion 53 and the first terminal 3 are appropriately brought into contact with each other, and the connection reliability between the short-circuiting terminal 13 and the first terminal 3 can be secured.

In addition, since there is no opportunity that the contact portion 53 comes into contact with the sliding slope 57 and the support portion 59, even if insulating materials attach to the sliding slope 57 or the support portion 59, they do not attach to the contact portion 53. Therefore, it is possible to prevent the insulating materials from interposing between the contact portion 53 and the first terminal 3, and the connection reliability between the short-circuiting terminal 13 and the first terminal 3 can be secured.

The contact housing portion 61 is provided with an insulating portion 65 which is formed of one member continuous with the second housing 9.

The insulating portion 65 is arranged on the lower end of the sliding slope 57, and in a state where the first housing 5 and the second housing 9 are fit together, the insulating portion 65 is arranged between the contact portion 53 and the first terminal 3.

Since the insulating portion 65 is arranged between the contact portion 53 and the first terminal 3 as described above, the insulating properties between the contact portion 53 and the first terminal 3 is maintained, and it is possible to prevent the short-circuiting terminal 13 and the first terminal 3 from conducting to each other in a state in which the first housing 5 and the second housing 9 are fit together.

The displacement portion 63 is one member continuous with the second housing 9 and is formed in a rib shape such that the tip of the first housing 5 is tapered. The displacement portion 63 is arranged adjacent to the sliding slope 57 in the direction in which the sliding protrusion 55 protrudes.

The displacement portion 63 is arranged so as to be positioned between the two contact pieces 11, 11 of the short-circuiting terminal 13. When the first housing 5 and the second housing 9 are fit together, the displacement portion 63 slides on the sliding protrusion 55 such that each contact piece 11, 11 is displaced in the direction in which each contact piece 11, 11 moves away from the sliding slope 57 in the width direction of each contact piece 11, that is, in the direction of the contact housing portion 61 side.

Due to the displacement of each contact piece 11 by the displacement portion 63, a restoring force tending to approach the sliding slope 57 acts on each contact piece 11.

The restoring force of each contact piece 11 ensures that the sliding protrusion 55 and the sliding slope 57 can be reliably slid. Thus, it is possible to stabilize the displacement of each contact piece 11 by the slide of the sliding protrusion 55 on the sliding slope 57.

Here, the tapering tip of the displacement portion 63 is arranged forward of the sliding slope 57 in the direction in which the first housing 5 and the second housing 9 are fit.

Therefore, when releasing the fitting between the first housing 5 and the second housing 9, the sliding protrusion 55 of each contact piece 11 finish the slide on the displacement portion 63 after finishing the slide on the sliding slope 57. After each contact piece 11 is restored downward, it is restored in the left-right direction.

Therefore, when the fitting between the first housing 5 and the second housing 9 is released, the contact portion 53 of each contact piece 11 slides on the outer circumferential surface of the first terminal 3 after it finishes contact with the first terminal 3.

Due to the sliding contact of the contact portion 53 with the outer peripheral surface of the first terminal 3, for example, the oxide film formed when tin plating or the like is applied to the contact portion 53 is broken, and the contact portion 53 and the first terminal 3 can be brought into contact with each other on the fresh surface. Thus, the connection reliability between the short-circuiting terminal 13 and the first terminal 3 can be improved.

The release portion 15 for displacing each contact piece 11 is arranged on the outer peripheral surface of the second housing 9 forward of the lock arm 17 in the direction in which the first housing 5 and the second housing 9 are fit.

Thus, the release portion 15 is not arranged on both sides of the lock arm 17. Therefore, the second housing 9 can be downsized in the width direction.

In addition, since the release portion 15 is not arranged on both sides of the lock arm 17, there is no need to provide the two contact pieces 11, 11 of the short-circuiting terminal 13 so as to avoid interference with the lock arm 17, and the two contact pieces 11, 11 can be arranged close to each other. Thus, the short-circuiting terminal 13 can be downsized in the width direction.

Since in this connector 1, the release portion 15 is arranged on the outer peripheral surface of the second housing 9 forward of the lock arm 17 in the direction in which the first housing 5 and the second housing 9 are fit, the release portions 15 are not arranged on both sides of the lock arm 17. Thus, the second housing 9 can be downsized in the width direction.

Further, the short-circuiting terminal 13 having the contact pieces 11, 11 from which the contact with the adjacent first terminals 3, 3 is released by the release portion 15 need not to be formed such that the contact piece 11, 11 contacting the adjacent first terminals 3, 3 avoids interference with the lock arm 17. Thus, the short-circuiting terminal 13 can be downsized in the width direction.

Therefore, in this connector 1, since the second housing 9 and the short-circuiting terminal 13 can be downsized in the width direction, it is possible to reduce the size.

Further, since the short-circuiting terminal housing chamber 19 is arranged to face the lock arm 17 in the direction in which the first housing 5 and the second housing 9 are fit, the height of the first housing 5 can be reduced. Thus, the connector 1 can be downsized.

In the connector according to the embodiment of the present invention, the displacement portion is positioned between the two contact pieces of the short-circuiting terminal and the two contact pieces are displaced by the one displacement portion, but the present invention is not limited to this. The two displacement portions may be provided for the two contact pieces of the short-circuiting terminal, respectively.

What is claimed is:

1. A connector comprising:

a first housing housing a plurality of first terminals;

a second housing housing a plurality of second terminals connectable to the respective first terminals, the second housing being fittable to the first housing;

a short-circuiting terminal housed in the first housing, the short-circuiting terminal having contact pieces configured to contact the respective first terminals which are adjacent to each other, the contact pieces being on a free end portion of the short-circuiting terminal facing the second housing; and a release portion provided on the second housing, the release portion configured to displace the contact pieces to release contact between the first terminals and the contact pieces, wherein the second housing is deflectably provided with a lock arm on an outer peripheral surface of the second housing, the lock arm configured to hold a state in which the first housing and the second housing are fit together, wherein the release portion is arranged on the outer peripheral surface of the second housing forward of the lock arm in a direction in which the first housing and the second housing are fit together, and wherein each of the contact pieces includes a sliding protrusion protruding in a width direction of the respective contact piece facing an adjacent contact piece of the short-circuiting terminal.

2. The connector according to claim 1, wherein the first housing is provided with a short-circuiting terminal housing chamber which houses the short-circuiting terminal, and wherein the short-circuiting terminal housing chamber is arranged to face the lock arm in the direction in which the first housing and the second housing are fit together.

3. The connector according to claim 1, wherein the contact pieces extend towards the second housing in parallel to one another.

4. A connector comprising:

a first housing housing a plurality of first terminals;

a second housing housing a plurality of second terminals connectable to the respective first terminals, the second housing being fittable to the first housing;

a short-circuiting terminal housed in the first housing, the short-circuiting terminal having contact pieces configured to contact the respective first terminals which are adjacent to each other, the contact pieces being on a free end portion of the short-circuiting terminal facing the second housing; and a release portion provided on the second housing, the release portion configured to displace the contact pieces to release contact between the first terminals and the contact pieces, wherein the second housing is deflectably provided with a lock arm on an outer peripheral surface of the second housing, the lock arm configured to hold a state in which the first housing and the second housing are fit together, wherein the release portion is arranged on the outer peripheral surface of the second housing forward of the lock arm in a direction in which the first housing and the second housing are fit together, wherein a displacement portion is arranged on the second housing to be positioned between two contact pieces, and wherein the two contact pieces are configured to move in a width direction away from each other as the two contact pieces move along the displacement portion.

5. A connector comprising:

a first housing housing a plurality of first terminals;

a second housing housing a plurality of second terminals connectable to the respective first terminals, the second housing being fittable to the first housing;

a short-circuiting terminal housed in the first housing, the short-circuiting terminal having contact pieces configured to contact the respective first terminals which are adjacent to each other, the contact pieces being on a free end portion of the short-circuiting terminal facing the second housing; and a release portion provided on the second housing, the release portion configured to displace the contact pieces to release contact between the first terminals and the contact pieces, wherein the second housing is deflectably provided with a lock arm on an outer peripheral surface of the second housing, the lock arm configured to hold a state in which the first housing and the second housing are fit together, wherein the release portion is arranged on the outer peripheral surface of the second housing forward of the lock arm in a direction in which the first housing and the second housing are fit together, wherein each of the contact pieces includes a sliding protrusion, the sliding protrusion configured to slide along a slope of the release portion, and wherein the sliding protrusion is offset from a contact portion of the respective contact piece, the contact portion configured to contact the respective first terminal.

6. The connector according to claim 5, wherein the sliding protrusion separates the contact portion from the release portion when sliding along the slope of the release portion.

* * * * *